US008578859B1

(12) United States Patent
Roy

(10) Patent No.: US 8,578,859 B1
(45) Date of Patent: Nov. 12, 2013

(54) CRAWL SPACE ORGANIZATION SYSTEM

(76) Inventor: John Walter Roy, Powell, OH (US)

( * ) Notice: Subject to any disclaimer, the term of this patent is extended or adjusted under 35 U.S.C. 154(b) by 108 days.

(21) Appl. No.: 12/723,393

(22) Filed: Mar. 12, 2010

Related U.S. Application Data

(60) Provisional application No. 61/159,849, filed on Mar. 13, 2009.

(51) Int. Cl.
*B61B 12/10* (2006.01)

(52) U.S. Cl.
USPC ..... 104/173.1; 104/183; 104/140

(58) Field of Classification Search
USPC ..... 104/176, 183, 173.1, 177, 180, 193, 104/139, 145, 172.3, 202, 178, 161, 138.1, 104/140
See application file for complete search history.

(56) References Cited

U.S. PATENT DOCUMENTS

| | | | | | |
|---|---|---|---|---|---|
| 805,342 | A | * | 11/1905 | Butler | 104/180 |
| 2,494,526 | A | * | 1/1950 | Tungett et al. | 280/480 |
| 2,661,573 | A | * | 12/1953 | Onley, Jr. | 446/451 |
| 3,295,832 | A | * | 1/1967 | Fowler | 254/389 |
| 4,430,023 | A | * | 2/1984 | Hayes et al. | 405/224 |
| 7,591,105 | B2 | | 9/2009 | Balser | |
| 2010/0201970 | A1 | * | 8/2010 | Pellen | 356/138 |

FOREIGN PATENT DOCUMENTS

| | | | |
|---|---|---|---|
| DE | 195 46 112 | * | 6/1997 |
| GB | 2158404 | * | 11/1985 |
| JP | 63147796 | * | 6/1988 |

* cited by examiner

*Primary Examiner* — Mark Le
(74) *Attorney, Agent, or Firm* — Bricker & Eckler LLP

(57) ABSTRACT

In an example embodiment, a mechanical crawl space organization system comprises a drive element which drives a winding element. The system further comprises a cable cooperating with at least one tubular conduit to define a drive path. The cable is mechanically connected to the winding element and a lead cart. The system enables the drive element to move the lead cart along a path defined by the cable guide.

26 Claims, 10 Drawing Sheets

"Elevation A"

CRAWL SPACE ORGANIZATION SYSTEM

CROSS-REFERENCE TO RELATED APPLICATION

This application claims priority to U.S. Provisional Patent Application Ser. No. 61/159,849 filed Mar. 13, 2009, which is incorporated by reference in its entirety as if fully set forth herein.

TECHNICAL FIELD

The present invention generally relates to crawl space organization systems. More specifically, the present invention relates to mechanical systems, devices and methods of use in providing users with a convenient, efficient way of storing and retrieving articles.

BACKGROUND

Many homes are constructed to comprise a crawl space which may be used to store personal articles and belongings. Many home owners who live in houses with a crawl space find storage of personal articles and belongings in a crawl space to be inconvenient, cumbersome and inefficient. A need exists for a system and apparatus to facilitate convenient and efficient storage of personal articles and belongings in a crawl space.

SUMMARY

According to a first aspect of the present application, a first example of a crawl space organization system is disclosed. The system comprises a drive element and a cable winding element mechanically driven by the drive element. The system further comprises a cable connected to the cable winding element and a cable guide cooperating with the cable to define a drive path. A lead cart is mechanically connected to the cable, and activation of the drive element causes the lead cart to travel along the drive path.

BRIEF DESCRIPTION OF THE DRAWINGS

The accompanying figures, which are incorporated in and constitute a part of the specification, illustrate various example apparatuses, systems, methods, and so on, and are used merely to illustrate various example embodiments. It should be noted that various components depicted in the figures may not be drawn to scale, and that the various assemblies and designs depicted in the figures are presented for purposes of illustration only, and should not be considered in any way as limiting.

DETAILED DESCRIPTION

As shown in the provided drawings and as described below, the disclosed apparatus and system provides an elegant solution to the problem of accessing storage crawl spaces in a home or other building via an efficient, cost effective and automated system and apparatus. The embodiments described herein allow a user to store articles in various storage containers and to access these containers from the exterior of the crawl space, that is, without the need for the user to physically crawl into the space. This is accomplished through a series of connected storage containers that may be moved forward and backward along a defined drive path or line of traversal via a motorized drive system.

The embodiments described herein accomplish the goal of increased convenience for users via a simple, and cost efficient design. Rather than requiring expensive parts such as chains or conveyor belts, the disclosed apparatus and system make use of inexpensive and readily available parts such as steel cables and metal conduits, in some embodiments. The disclosed apparatus and system do not require pulleys or tracks because, pursuant to the novel design herein, the storage carts themselves self orientate along the desired line of traversal. As described below, the storage carts in one embodiment are pulled from below, rather than from above, eliminating the need for a complicated series of custom located pulleys. Moreover, each storage cart contains a set of concave guide wheels that straddle a conduit containing the drive cable, thus allowing the carts to remain properly orientated along the line of traversal without the need for tracks.

As will be readily apparent to one of ordinary skill in the art, the embodiments described herein contain an additional advantage over the prior art of allowing for a generally uniform and inexpensive means of installing the device in a variety of differently dimensioned crawl spaces.

Figure 1:
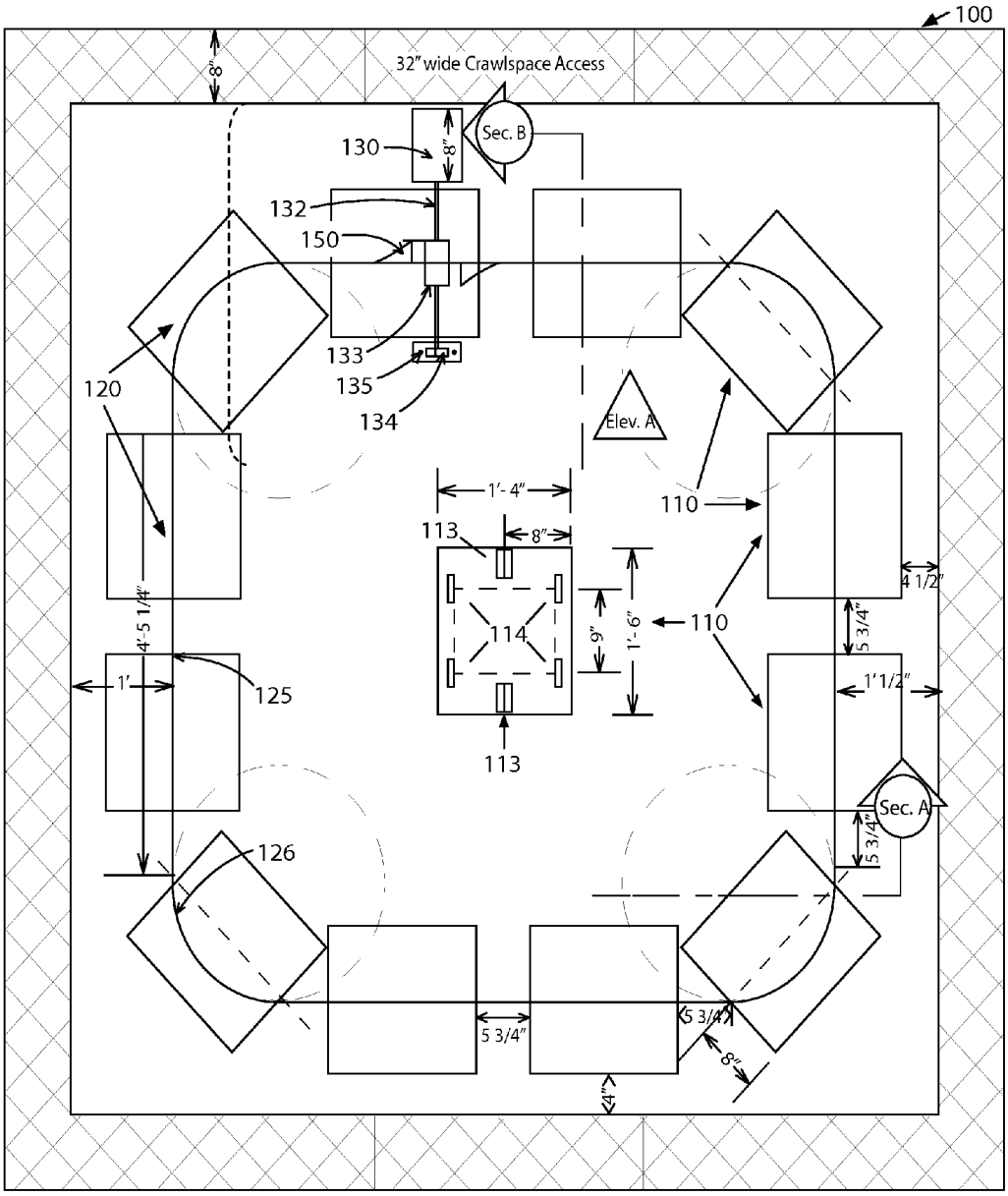
FIG. 1 is a plan view of one embodiment of a mechanical crawlspace organization system.

FIG. 1 discloses one possible configuration of an example embodiment of a crawl space organization apparatus 100. Depicted is a drive element 130 for pulling at least a lead cart or storage means 110 along a drive path or line of traversal 120. As shown in the configuration of FIG. 1, storage means 110 may comprise a plurality of storage containers or carts. The line of traversal 120 of this configuration is an enclosed loop as shown. In the illustrated embodiment, curved conduits may run 20.02" in length and have a 25.5" diameter. The system in the illustrated crawl space may use one (1) 10' length cut to four (4) 21" corners and sized to suit. Of course, these are merely sample dimensions for the spacing of storage carts and other elements, which one of ordinary skill in the art would understand to be representative of but one of many potential configurations of these elements.

Figure 2:
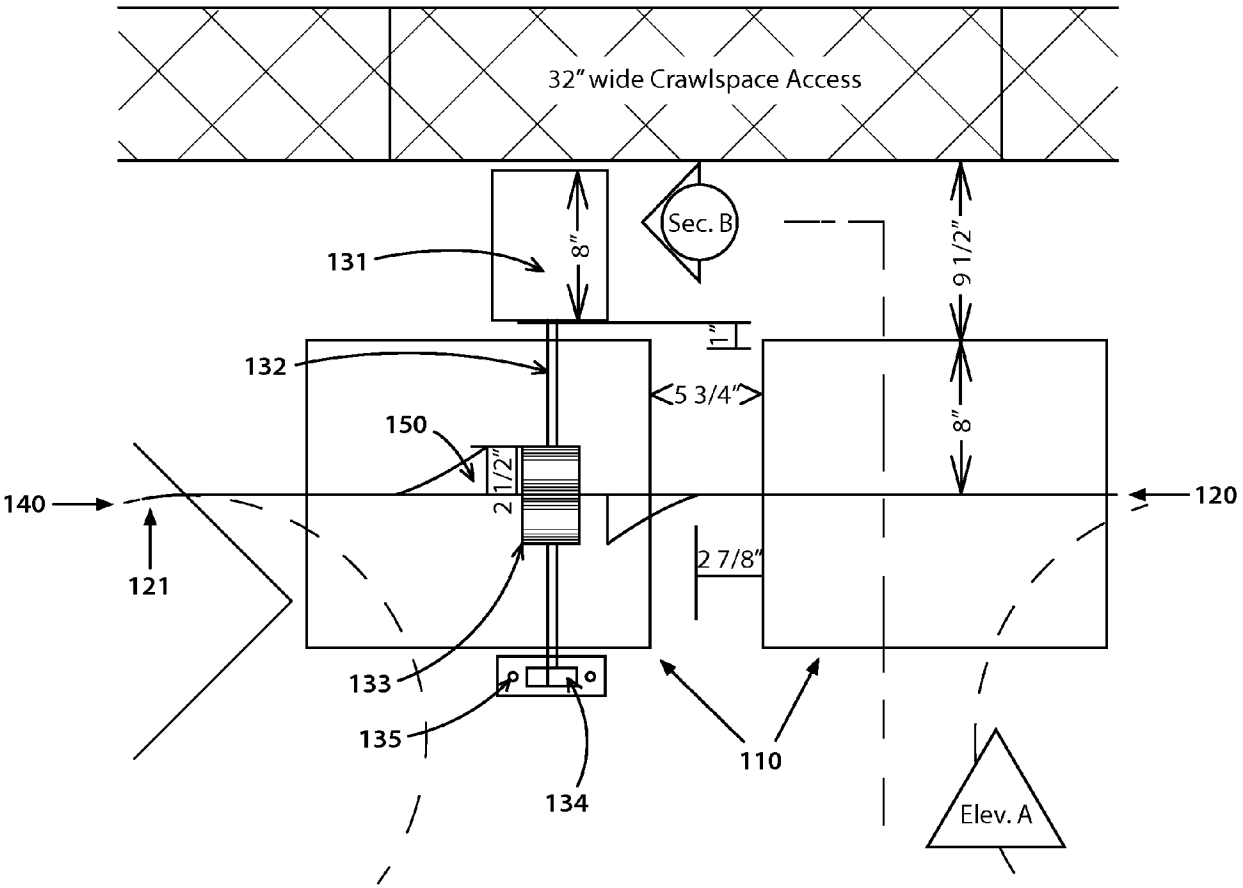
FIG. 2 is an enlargement of the element for pulling of the embodiment depicted in FIG. 1.

As shown in the example embodiment of FIG. 2, the drive element 130 comprises an electric motor 131, which may be securely mounted on lower plywood substrate between two by four inch framing members (not depicted). Connected to the motor 131 is a drive shaft 132 extending through winding reels 133 and rotateably affixed to a shaft cradle 135 with carrier bearings 136. As shown in this embodiment, the carrier bearings are securely affixed to the substrate (not depicted) using cradle mounting bolts 134.

In one embodiment, the winding reels 133 comprise two three inch diameter reels, also referred to as "split drum winding reels." Each reel may be attached to one end of a drive cable 140, which extends the length of the line of traversal 120 via conduit 121 that forms guiding means. Conduit 121 may be embodied as ½" round metal conduit aluminum or steel, screwed to a substrate with ⅛"×1 and ½" Phillips pan head screws.

Driving means is formed by drive element 130, drive shaft 132, and winding reels 133. The drive element 130 may be used to engage the winding reels 133 in a clockwise or counter-clockwise motion, causing the conduit to spool on one reel as it unspools on the other. As discussed in greater detail below, the drive cable 140 is attached to the storage means 110, allowing the element 130 to move the storage means 110 forward along the line of traversal 120 by spooling the drive cable 140 on one of the two winding reels 133. Likewise, the storage means 110 may be moved backward along the drive path by reversing the rotation of the winding reels 133 such that the drive cable 140 unspools from the first winding reel and spools on the other.

As also depicted in FIG. 2, one example embodiment includes a custom flared conduit end 150, which may be attached to the ends of the conduit 121 on either side of the winding reels 133. As discussed in greater detail below, the custom flared conduit end 150 helps to guide the drive cable 140 onto the winding reels 133 while reducing friction.

Referring back to FIG. 1, example embodiments for the conduit sections are shown for use with the configuration of FIG. 1. By way of example, straight conduit lengths 125 may consist of one half inch diameter metal conduit with a lengthwise three sixteenth inch opening along the top and a series of three sixteenth inch pilot holes along the bottom. As discussed in more detail below, the lengthwise opening at the top allows for connection to the drive cable 140 to the storage means 110. The pilot holes along the bottom provide a convenient means of securing the conduit to plywood substrate by passing nails or screws or some other fastening means through the holes and into the substrate.

Also depicted in FIG. 1 is one example embodiment of a storage container of the storage means 110. Roller wheels 114, which may be 2" diameter steel swivel roller wheels, are located at each corner of the rectangular bottom of the depicted storage container. These roller wheels 114 support the load and allow the storage means 110 to move over the substrate along the line of traversal 120 when the drive cable 140 is wound around the winding reels 133. In one embodiment, the rectangular bottom of the storage container of the storage means 110 may be one foot four inches wide by one foot six inches long. In one embodiment the roller wheels 114 may have a nine inch wheel base.

Also shown are two guide wheels 113, which, in one embodiment, may be 2" diameter steel swivel roller wheels located in the center-front and center-back of the rectangular bottom of the depicted storage container. As discussed in more detail below, these guide wheels 113 may have a concave center portion in one embodiment which allows the guide wheels 113 to straddle the conduit 121 and thereby maintain the orientation of the storage means 110 along the line of traversal 120.

Figure 3:
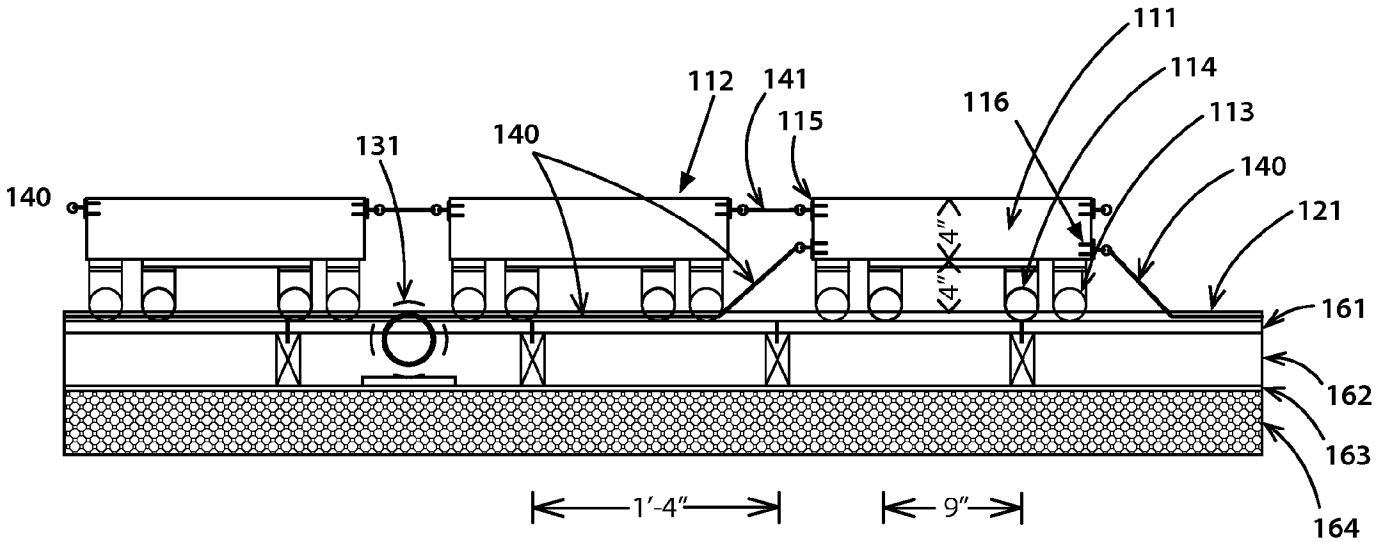
FIG. 3 is an elevation view of one embodiment of a storage means of the system and embodiments of means for moving and supporting a storage means.

Turning now to FIG. 3, two forms of storage carts of the storage means 110 are depicted, a drive cart 111 and a tow cart 112. In one embodiment, the storage means 110 consists of one drive cart 111 and a plurality of tow carts 112. In one embodiment, the drive car 111 and tow cars 112 may have a wheel base of approximately 9". In this embodiment, the drive cart 111 connects to tow carts on either side via tow cables 141, which are affixed to each cart via tow cable mounting plates 115, located near the top edge of the front and back of each cart. In the illustrated embodiment, tow cables 141 may be ⅛" steel or similar cables which may be configured to provide approximately 5.75" of separation between carts.

In one embodiment, the drive cart 111 also contains a set of drive cable mounting plates 116 below each of the two cable mounting plates 115. The drive cable mounting plates 116 allow the drive cable 140 to attach to each end of the drive cart 111. The drive cable 140 extends at an angle, roughly forty five degrees in one embodiment, from the drive cable mounting plate to the conduit 121. The drive cable 140 is held down by the guide wheels of each of the tow carts 110, which may extend, at regular intervals, the entire length of the line of traversal 120 via the conduit 121. In an alternate embodiment, a gap may be allowed in the chain of tow carts 112 to enable users to access the area inside of the closed loop formed by the line of traversal 120.

In one embodiment, the conduit 121 may be securely affixed to a plywood substrate 161 via screws, which pass through the aforementioned pilot holes located along the bottom of the conduit 121, through the substrate 161, such as ¾" tongue and groove plywood, and into framing members 162. In one embodiment, the framing members 162 may rest upon or, alternately, be secured to a lower plywood substrate 163, such as ¾" tongue and groove plywood. In one embodiment the lower substrate 163 may rest upon a bed of aggregate 164.

In one embodiment, an electric motor 131 of the drive element 130 is mounted on the lower plywood substrate 161 between the framing members 162.

In the depicted embodiment, the tow carts 112 are four inches by sixteen inches by eighteen inches and are spaced five and three quarter inches apart from each other and/or the drive cart 111. In the depicted embodiment, the distance between framing members 162 is one foot four inches. In the depicted embodiment, the tow cable is one-eighth inch steel or similar.

In the depicted embodiment, the drive cart 111 is four inches by sixteen inches by eighteen inches. In one embodiment, the clearance of each of the drive cart 111 and the plurality of tow cars 112 is four inches above the substrate 161. In one embodiment screws are used to secure the conduit to the substrate 161, said screws may be three quarters of an inch long, and the framing members 162 may be two inches by four inches spaced apart approximately 1' 4". In one embodiment, the lower plywood substrate 163 may be a half inch. In one embodiment the aggregate 164 may consist of two to four inches of crushed gravel with six mil vapor barrier.

Figure 4:
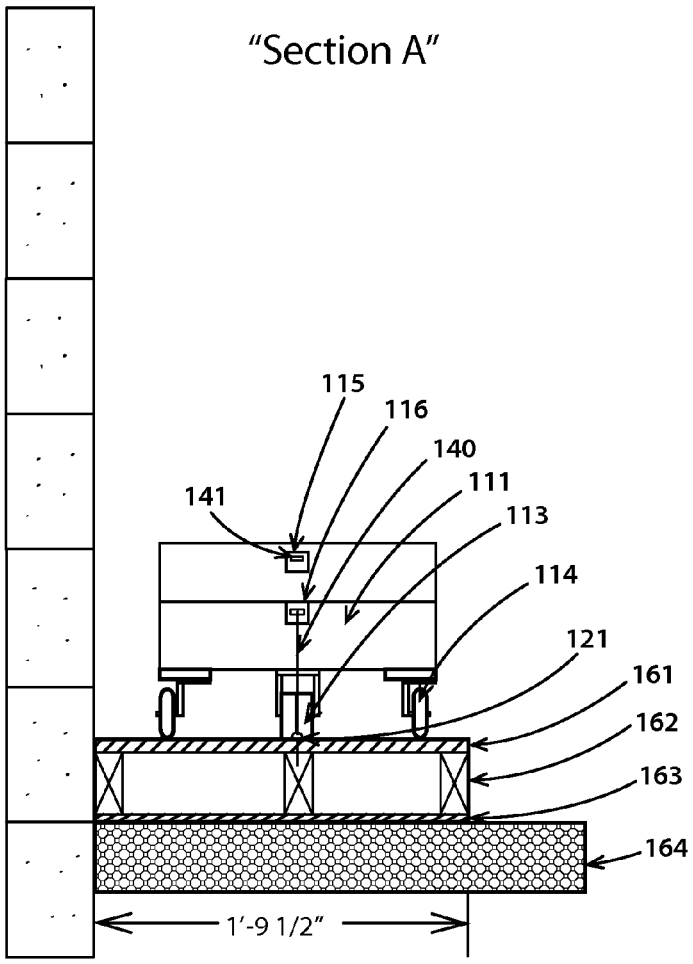
FIG. 4 is a sectional view of an embodiment of the system in which a drive cart of a storage means is shown at a point along a line of traversal that is distant from a user access point.

FIG. 4 provides a sectional view of one embodiment of the system in which the drive cart 111 is located at a point along the line of traversal 120 that is distant from a user access point. As shown in the drawing, the tow cable 141 is orthogonally projected from the tow cable mounting plate, located near the top edge of the drive cart 111. The drive cable 140 is shown extending from the drive cable mounting plate 116 to the conduit 121, which is affixed to the substrate 161 and framing members 162 via screws or some convenient alternative fastening means.

Figure 5:
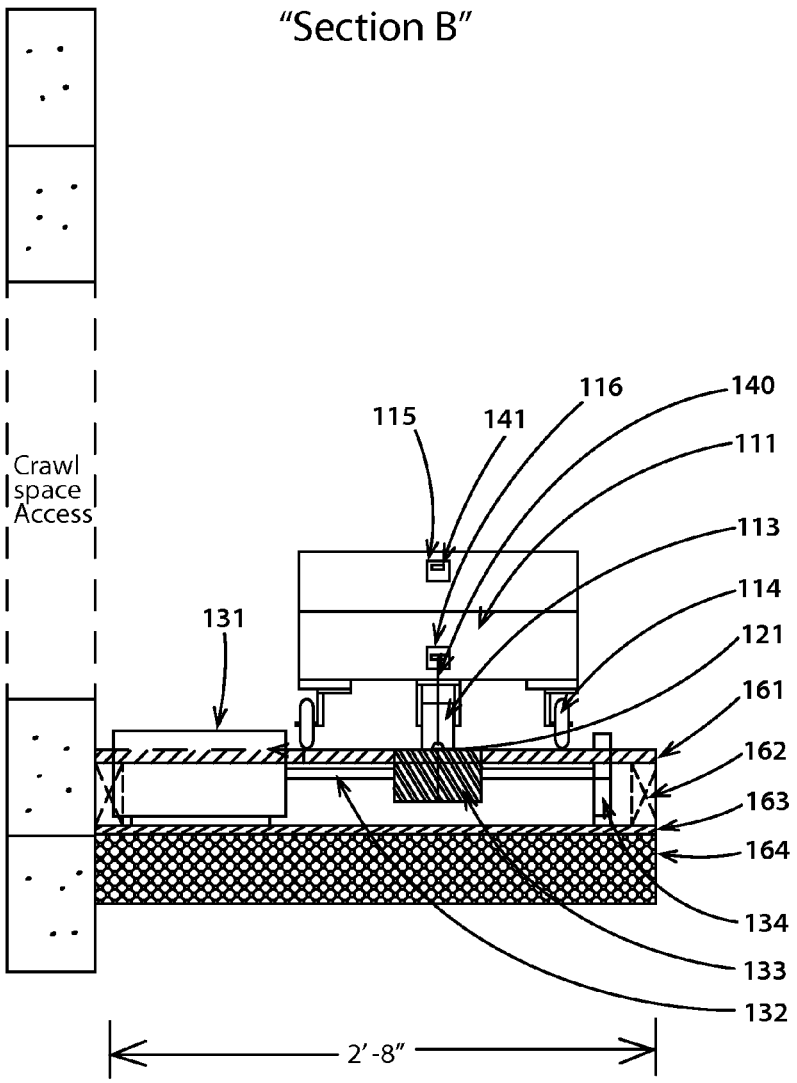
FIG. 5 is a sectional view of an embodiment of the system in which a drive cart of a storage means is shown at a point along a line of traversal that is near a user access point.

FIG. 5 provides a sectional view of one embodiment of the system in which the drive cart 111 is located at a point along the line of traversal 120 that is proximal the user access point. As shown in the embodiment of FIG. 5, the drive element 130, including the motor 131, drive shaft 132, winding reels 133, and drive shaft cradle 134, are each located substantially below the substrate 161 with some portions slightly above the substrate 161 (shown). In an alternative embodiment the drive element 130 may be completely located below the substrate 161. In one embodiment, the drive element 130 may be located proximal the user access point (shown). In an alternative embodiment, the drive element 130 could be located at a point distal to the user access point. In one embodiment, the motor 131 is located on the exterior of the enclosed loop formed by the line of traversal 120 and the drive shaft cradle 134 is located in the interior portion of this enclosed loop (shown). In another alternative embodiment, the position of the motor 131 and drive shaft cradle 134 could be switched such that the motor is located on the interior of the enclosed loop formed by the line of traversal 120.

Figure 6:
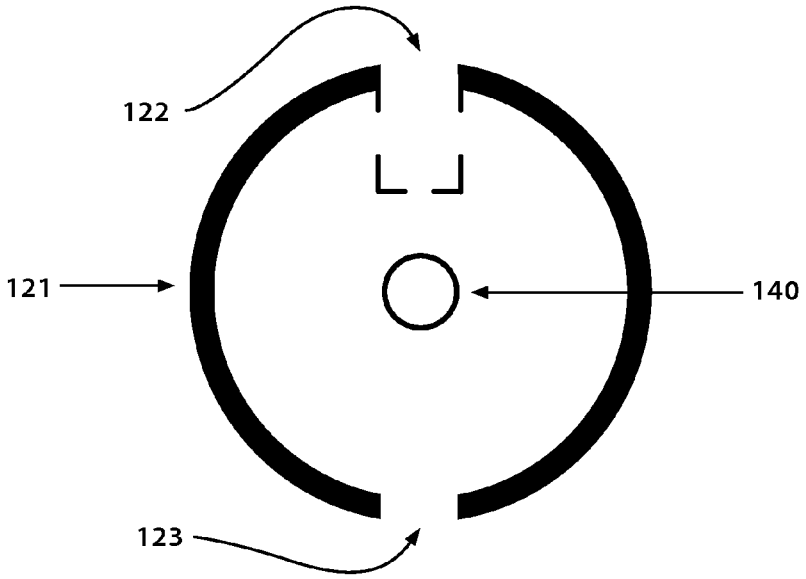
FIG. 6 is a sectional view of an embodiment of the system in which a conduit and drive cable for pulling a drive cart of a storage means is depicted.

Turning now to FIG. 6, one embodiment of the system is shown in which the conduit 121 is half-inch in diameter and is made of metal. Other diameters and other materials could be substituted. In one embodiment, a top section 122 is cut in the top of the conduit 121 such that a gap is formed. In one embodiment, this gap is three sixths of an inch. In one embodiment, a series of pilot holes 123 are drilled at specified internals. In one embodiment, straight conduit runs 125 have pilot holes 123 every sixteen inches. In one embodiment, conduit corner pieces 126 have pilot holes 123 every six inches. Edges of the conduit may be rounded and ground smooth. As shown in FIG. 6, in one embodiment of the system the drive cable 140 is positioned on the interior of the conduit 121. The position of the drive cable 140 within the conduit 121 may vary.

Figure 7A:
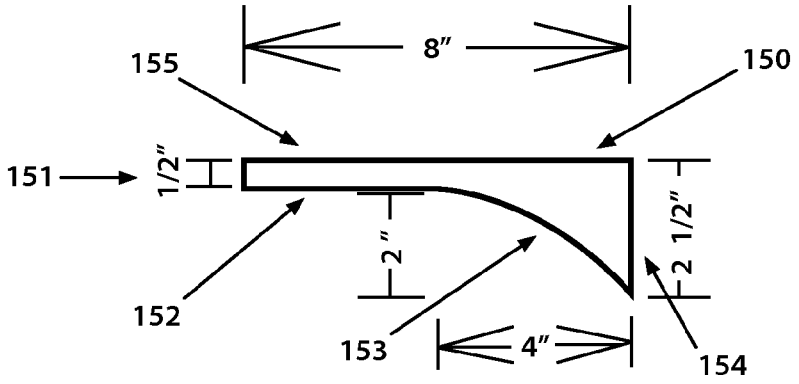
FIG. 7A is a plan view of an embodiment of the system in which a flared conduit end is depicted.
Figure 7B:
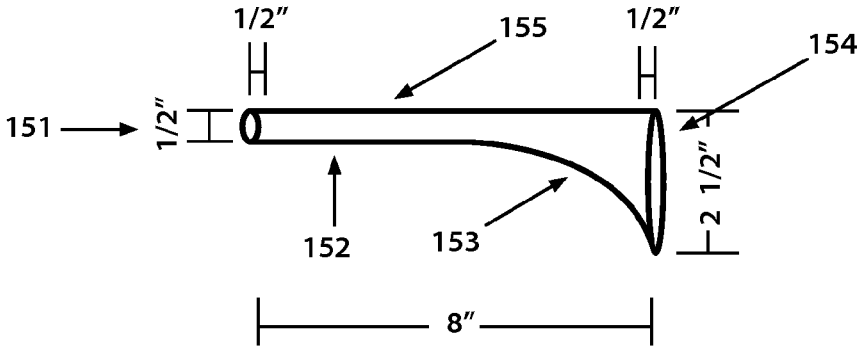
FIG. 7B is an elevation view of an embodiment of the system in which a flared conduit end is depicted.

In FIG. 7A and FIG. 7B one embodiment of the custom flared conduit end 150 is shown. FIG. 7A provides a plan view of the embodied conduit end 150, including a half inch opening 151 connecting to the half inch diameter conduit 121, on one end, and a two and a half inch opening 154, located proximal one of two winding reels 133, on the other. The embodied flared conduit end 150 includes one eight inch side portion 155, running the length of the flared conduit end 150, and an opposite side consisting of a four inch straight portion 152, proximal the half inch opening 151, and a four inch flared portion 153, proximal the two and a half inch opening.

The embodiment of the flared conduit end 150 shown in the plan view of FIG. 7A is shown in perspective in FIG. 7B, further specifying that in one embodiment of the flared conduit end 150 a wide opening 154, which is proximal the winding reels 133 is two and a half inches wide by one half inch high, forming an oval.

Figure 8:
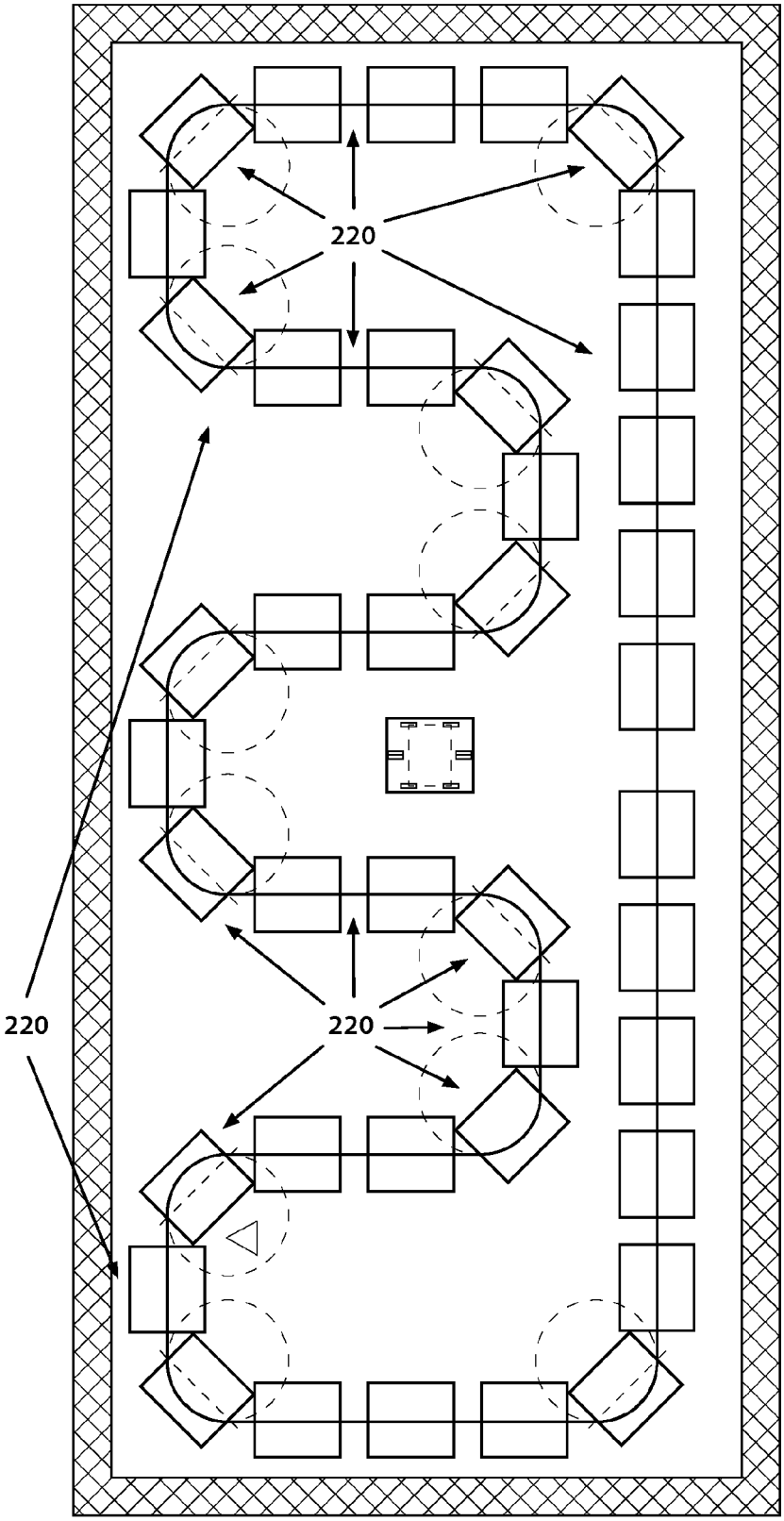
FIG. 8 is a plan view of one embodiment of an apparatus depicting one alternative configuration of a line of traversal.

Turning now to FIG. 8, an alternative configuration of the system is shown in which the winding line of traversal 220 is employed to maximize the interior space utilization.

Figure 9A:
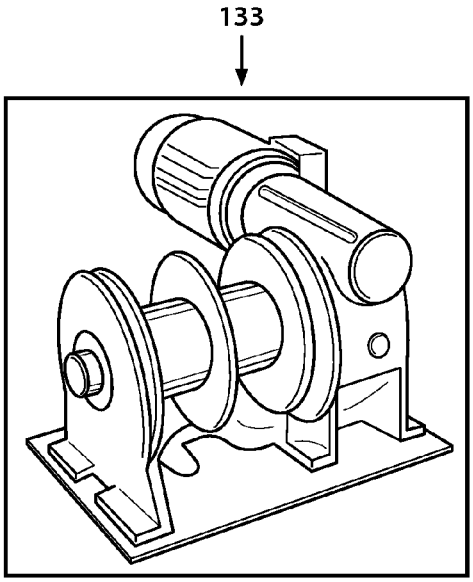
FIGS. 9A-9C depict multiple embodiments of winding elements.
Figure 9B:
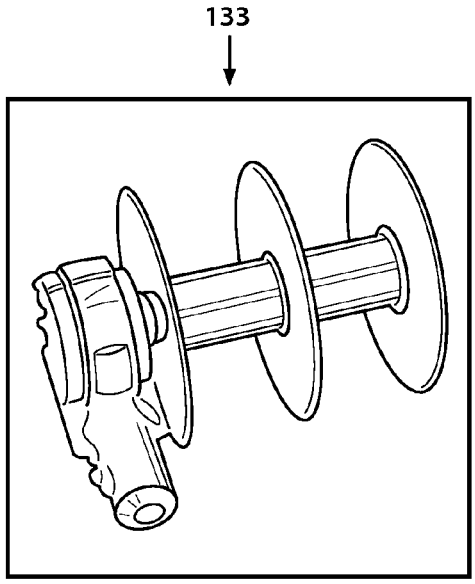
Figure 9C:
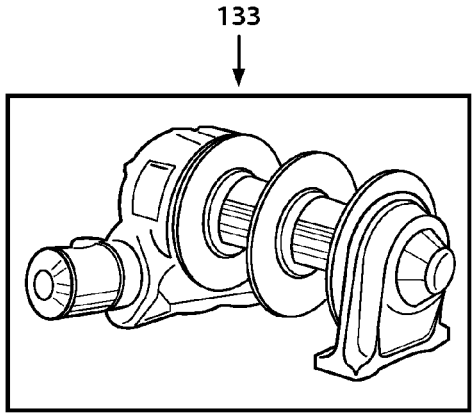

FIGS. 9A-9C provide several examples of embodiments of split drum winches or winding reels 133 as used in the system.

Figure 10A:
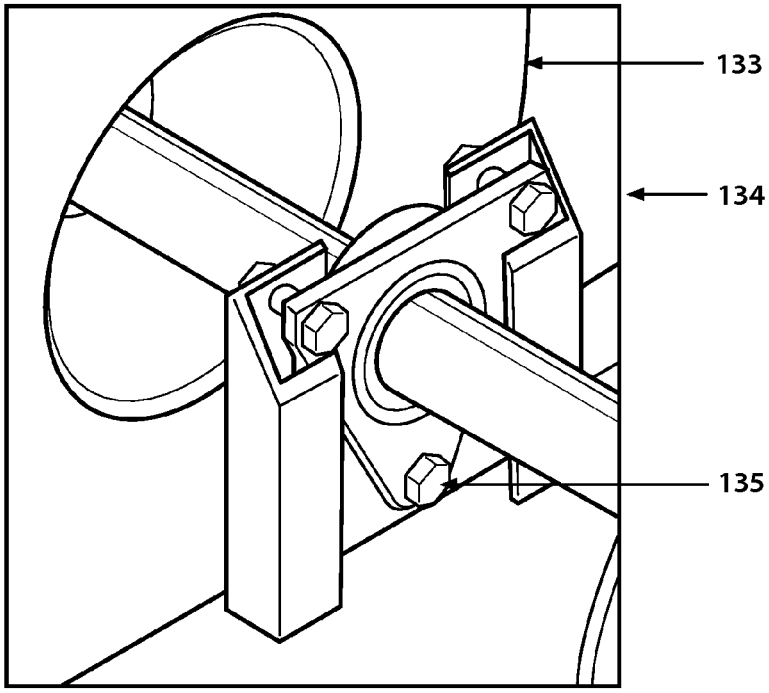
FIGS. 10A and 10B depict multiple embodiments of base mount carrier bearings.
Figure 10B:
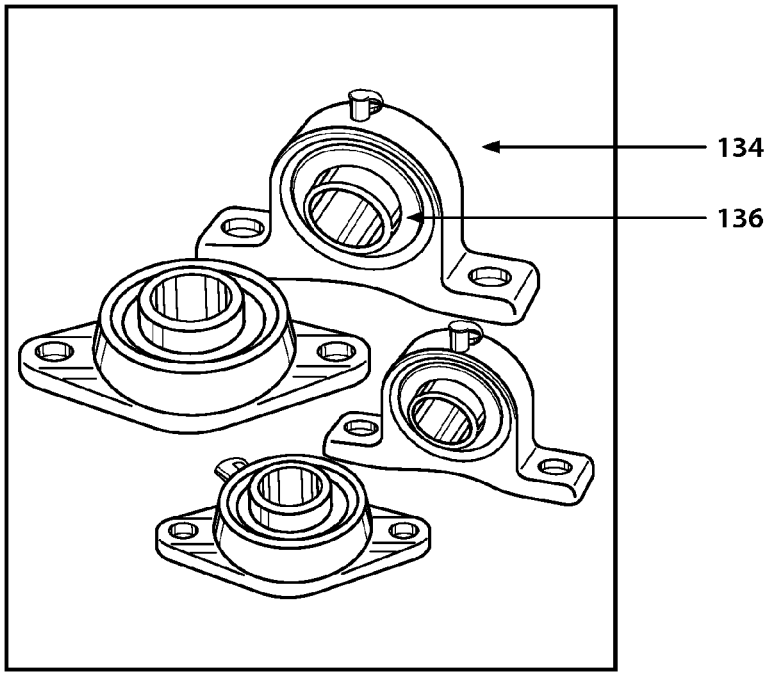

FIG. 10 provides FIGS. 10A and 10B provide examples of shaft cradles 134 with carrier bearings 136 and mounting bolts 135.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Furthermore, while the devices, systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the devices, systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. An apparatus for accessing items, comprising:
- a reversible drive that includes
  - a motor,
  - a drive shaft connected to the motor, and
  - a winding reel configured to take up a drive cable;
- a guide conduit
  - configured to permit passage of the drive cable within an interior region of the guide conduit and to permit a portion of the drive cable to extend out of the guide conduit through an opening;
- a drive cart connected to the drive cable, including
  - at least one drive cart guide wheel configured to travel on the guide conduit; and
- a tow cart connected to the drive cart by a tow cable, including
  - at least one tow cart guide wheel arranged on the guide conduit and at least partially retaining the drive cable within the interior region of the guide conduit.

2. The apparatus of claim 1, wherein the reversible drive element further includes
- a cradle configured to rotatably support the drive shaft.

3. The apparatus of claim 2, wherein the winding reel is a split drum winding reel.

4. The apparatus of claim 3, wherein the guide conduit is further configured to be attached to a substrate.

5. The apparatus of claim 4, wherein the drive cart further includes a drive cart roller wheel.

6. The apparatus of claim 5, wherein the tow cart further includes a tow cart roller wheel.

7. The apparatus of claim 6, wherein each of the drive cart guide wheel and the tow cart guide wheel includes a generally concave surface mated with a generally convex surface of the guide conduit.

8. The apparatus of claim 1, wherein the tow cart is one tow cart of a group of tow carts, and each tow cart of the group of tow carts is connected to at least one of the drive cart and a second tow cart of the group of tow carts.

9. The apparatus of claim 8, wherein the reversible drive element further includes a cradle configured to rotatably support the drive shaft.

10. The apparatus of claim 9, wherein the winding reel is a split drum winding reel.

11. The apparatus of claim 10, wherein the guide conduit is further configured to be attached to a substrate.

12. The apparatus of claim 11, wherein the drive cart further includes a drive cart roller wheel.

13. The apparatus of claim 12, wherein the tow cart further includes a tow cart roller wheel.

14. The apparatus of claim 13, wherein each of the drive cart guide wheel and the tow cart guide wheel includes a generally concave surface mated with a generally convex surface of the guide conduit.

15. An apparatus for accessing items, comprising:

means for driving a drive cart;

means for guiding a drive cart along a drive path;

a drive cable provided in the means for guiding, and a portion of the drive cable to extend out of the means for guiding;

a drive cart connected to the drive cable and including at least one drive cart guide wheel configured to travel on the means for guiding; and a tow cart connected to the drive cart by a tow cable and including at least one tow cart guide wheel arranged on the means for guiding and at least partially retaining the drive cable within the means for guiding.

16. The apparatus of claim 15, wherein the apparatus further includes a cradle configured to rotatably support a part of the driving means.

17. The apparatus of claim 15, wherein the means for guiding is further configured to be attached to a substrate.

18. The apparatus of claim 17, wherein the drive cart further includes a drive cart roller wheel.

19. The apparatus of claim 18, wherein the tow cart further includes a tow cart roller wheel.

20. The apparatus of claim 19, wherein each of the drive cart guide wheel and the tow cart guide wheel includes a generally concave surface mated with a generally convex surface of the means for guiding.

21. The apparatus of claim 15, wherein the tow cart is one tow cart of a group of tow carts, and each tow cart of the group of tow carts is connected to at least one of the drive cart and a second tow cart of the group of tow carts.

22. The apparatus of claim 21, wherein the apparatus further includes a cradle configured to rotatably support a part of the driving means.

23. The apparatus of claim 21, wherein the means for guiding is further configured to be attached to a substrate.

24. The apparatus of claim 23, wherein the drive cart further includes a drive cart roller wheel.

25. The apparatus of claim 24, wherein the tow cart further includes a tow cart roller wheel.

26. The apparatus of claim 25, wherein each of the drive cart guide wheel and the tow cart guide wheel includes a generally concave surface mated with a generally convex surface of the means for guiding.

* * * * *